United States Patent [19]

Wood

[11] 4,286,704

[45] Sep. 1, 1981

[54] COIN-VALIDATING ARRANGEMENT

[75] Inventor: Dennis Wood, Oldham, England

[73] Assignee: Coin Controls Limited, Royton, England

[21] Appl. No.: 142,682

[22] Filed: Apr. 22, 1980

[30] Foreign Application Priority Data

Apr. 27, 1979 [GB] United Kingdom ..... 14716/79

[51] Int. Cl.[3] ..... G07F 3/02

[52] U.S. Cl. ..... 194/100 A; 194/102

[58] Field of Search ..... 194/97 R, 100 R, 100 A, 194/102; 73/163

[56] References Cited

U.S. PATENT DOCUMENTS

| | | | |
|---|---|---|---|
| 3,481,443 | 12/1969 | Meloni | 194/100 R |
| 3,977,508 | 8/1976 | Baumberger | 194/102 X |
| 4,128,158 | 12/1978 | Dautremont | 194/100 A |

*Primary Examiner*—Joseph J. Rolla

*Attorney, Agent, or Firm*—Laubscher & Laubscher

[57] ABSTRACT

A coin-validating arrangement including a coin guide path and a sensing coil disposed adjacent said path, the coil being part of a tuned circuit coupled into a negative feedback path of an amplifier whereby to produce a phase shift sufficient to result in positive feedback and oscillation in said amplifier in the absence of a correct coin at the region of said path adjacent said coil, the tuned circuit being so arranged that on passage of a correct coin past said region the oscillation is quenched or reduced in amplitude, a circuit being provided for detecting the quenching or amplitude reduction of said oscillation, and a threshold detector provided for responding to said detecting circuit and opening an acceptance gate for the said correct coin.

18 Claims, 8 Drawing Figures

COIN-VALIDATING ARRANGEMENT

BACKGROUND OF THE INVENTION

The invention relates to coin-validating arrangements, for use in coin-operated mechanisms. Such mechanisms may, for example, be vending machines, ticket issuing machines, turnstile or barrier controlling machines or change-giving machines, amusement and gaming machines, amusement and gaming machines.

SUMMARY OF THE INVENTION

The invention consists in a coin-validating arrangement comprising a coin guide path and a sensing coil disposed adjacent said path, the coil being part of a tuned circuit coupled into a negative feedback path of an amplifier whereby to produce a phase shift sufficient to result in positive feedback and oscillation in said amplifier in the absence of a correct coin at the region of said path adjacent said coil, the tuned circuit being so arranged that on passage of a correct coin past said region the oscillation is quenched or reduced in amplitude, means being provided for detecting the quenching or amplitude reduction of said oscillation, further means being provided for responding to said detecting and opening an acceptance gate for the said correct coin.

It will be appreciated that passage of a coin past the sensing coil causes energy losses to occur, which affect the Q factor of the coil. In the case of a coin of non-ferrous or non-magnetic materials, the energy losses are mainly the result of eddy currents set up within the coin. Ferrous coins affect the alternating field of the coil by a magnetic hysteresis effect, due to residual magnetism in the coins. The magnitude of the energy loss depends on the nature and size of the coin. Coins of various alloys and metals cause differing energy losses due to their sensitivity and/or permeability characteristics and the frequency of the flux changes.

In order to ensure that the oscillation of the oscillator/amplifier is sufficiently reduced in amplitude or is quenched on passage of a coin along the guide path, preferably two sensing coils are provided which are closely spaced from each other with the coin guide path extending between them.

By adjusting the operating parameters of the amplifier/oscillator and tuned circuit, a sensitive response to a given correct coin of given diameter can be ensured.

BRIEF DESCRIPTION OF THE DRAWINGS

There follows a detailed description of the preferred embodiments to be read with reference to the accompanying drawings which are given by way of example and in which.

DETAILED DESCRIPTION OF THE PREFERRED EMBODIMENTS

Figure 1:
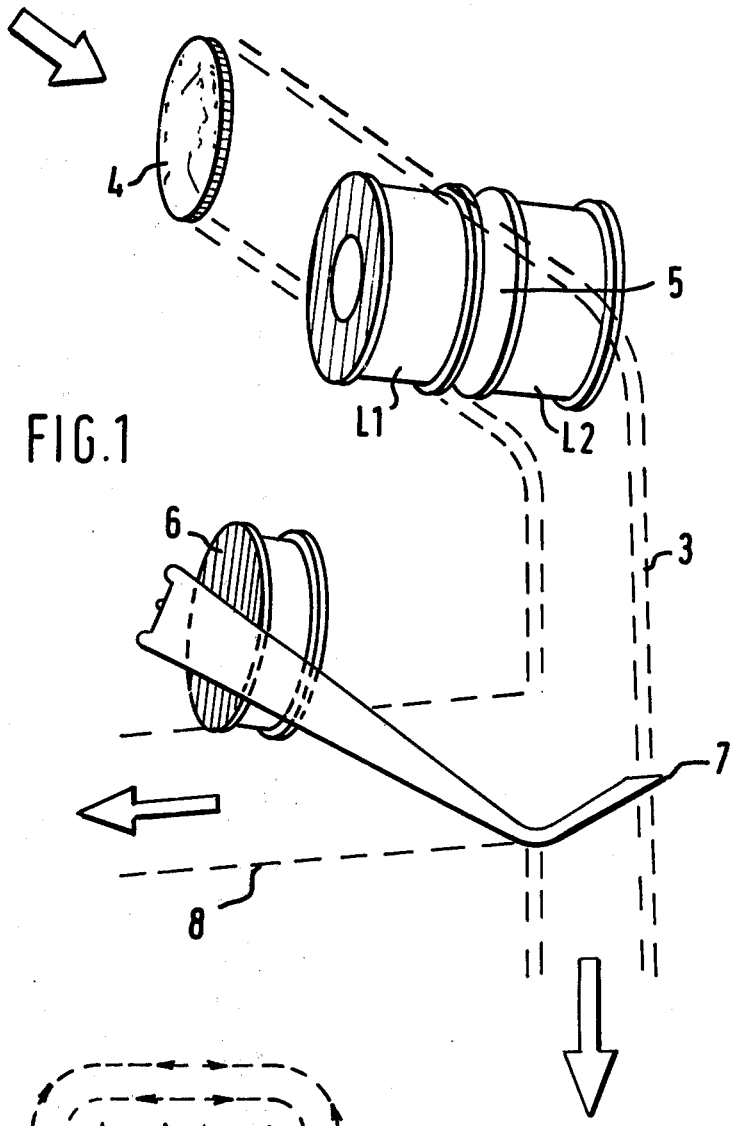
FIG. 1 is a diagrammatic perspective view showing a coin guide path and an arrangement of sensing coils.
Figure 2:
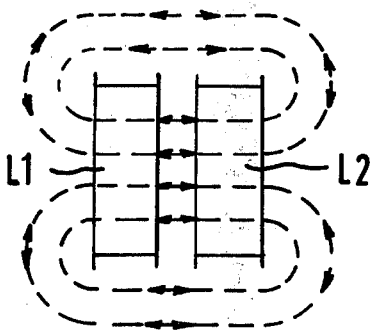
FIG. 2 illustrates a typical flux path provided by the sensing coils.

As shown in FIG. 1, the coin-validating arrangement comprises a pair of sensing coils L1 and L2 closely spaced and arranged at opposite sides of a coin guide path 3. A coin 4 travelling along the path 3 passes between the coils L1 and L2 at a region 5 of the path 3 and influences the alternating field of the coils. A typical field is shown in FIG. 2 and the establishment of the field will be explained hereinafter with reference to FIG. 3.

If a coin passing between the coils L1 and L2 is a correct coin, a solenoid 6 is energized, opening an acceptance gate 7 for the coin. Otherwise, the coin is deflected to a rejection path 8.

Figure 3:
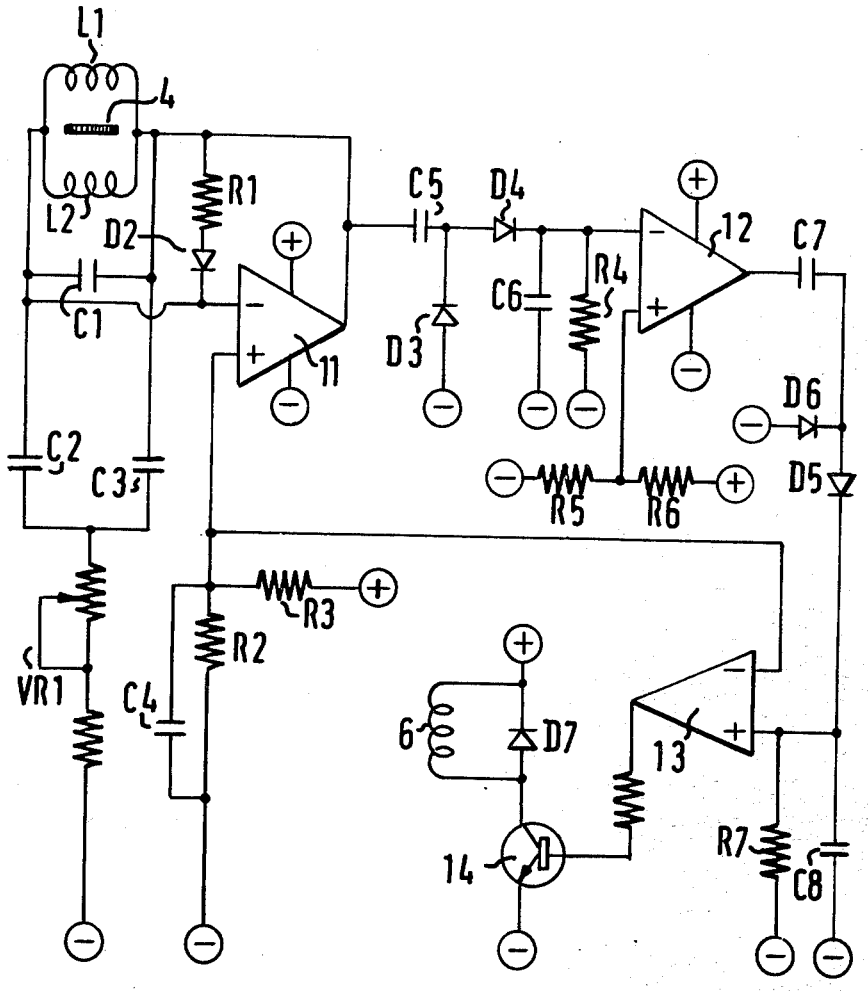
FIG. 3 is a circuit diagram of a coin-validating arrangement of the invention.

Referring now to FIG. 3 it will be seen that the coils L1 and L2 are connected in parallel. They are arranged to give fluctuating fields extending through both coils and across the gap between the coils, as shown in FIG. 2. The coils form a tuned circuit in combination with capacitors C1, C2 and C3.

An amplifier 11 is provided, which may be a conventional amplifier but which preferably, as illustrated, is an operational amplifier, its non-inverting input being supplied with a predetermined voltage from a voltage divider R2, R3. Resistor R2 is bridged by a by-pass capacitor C4, although the provision of capacitor C4 is not essential.

The operational amplifier 11 has a negative feedback loop to its inverting input, provided by resistor R1 and diode D2. The tuned circuit constituted by coils L1 and L2 and capacitors C1, C2 and C3 is coupled to the negative feedback loop and an adjusting resistor arrangement VR1 enables the response threshold of the tuned circuit and amplifier combination to be set. If desired, R1, D2 and C1 may be omitted.

Normally the resistor VR1 is adjusted so that in the absence of a correct coin between the sensing coils L1 and L2, the amplifier 11 oscillates, whereas when a correct coin is present between the coils L1 and L2 the oscillation is quenched. Thus, the resistor VR1 enables the quench point to be set for a given type of coin to be detected.

Assuming that the amplifier 11 is oscillating, a corresponding output signal is fed through capacitor C5 to a rectifying arrangement comprising diodes D3 and D4. The resulting dc signal is applied to capacitor C6 which is bridged by a bleed resistor R4. With steady oscillation, the capacitor C6 is brought up to a given voltage level and this voltage is applied to the inverting input of an operational amplifier 12 which is arranged as a threshold detector, its non-inverting input being supplied with a reference voltage from a voltage divider composed of resistors R5 and R6. Normally, the output of the amplifier 12 is low but when the voltage applied from capacitor C6 drops below the said reference voltage, the output of the amplifier 12 goes high. This occurs briefly whenever a correct coin is sensed by the sensing coils L1 and L2.

The output of the amplifier 12 is fed through a capacitor C7 and a diode D5 to a capacitor C8 which is bridged by a bleed resistor R7. The junction between the capacitor C7 and the diode D5 is connected to a diode D6, the capacitor C7 and diode D6 forming a fail safe stage which will be described later.

The voltage on capacitor C8, received by way of the diode D5, is fed to the non-inverting input of an operational amplifier 13, the inverting input being supplied with a reference voltage from the voltage divider R2, R3. When the voltage on capacitor C8 exceeds the reference voltage, the output of the amplifier 13 changes from a low state to a high state, turning on a transistor 14 which acts as a switch for the solenoid 6, the transistor 14 being protected from solenoid switching inductive surges by a diode D7. Instead of the transistor 14, a two stage transistor driver arrangement or a thyristor arrangement (not shown) can be provided.

Normally, in the absence of a correct coin, there is steady oscillation of the amplifier 11, and the output of the threshold detector amplifier 12 remains low, so that capacitor C8 is not charged sufficiently for the amplifier 13 to respond. Thus, the solenoid 6 remains de-energized.

Figure 5:
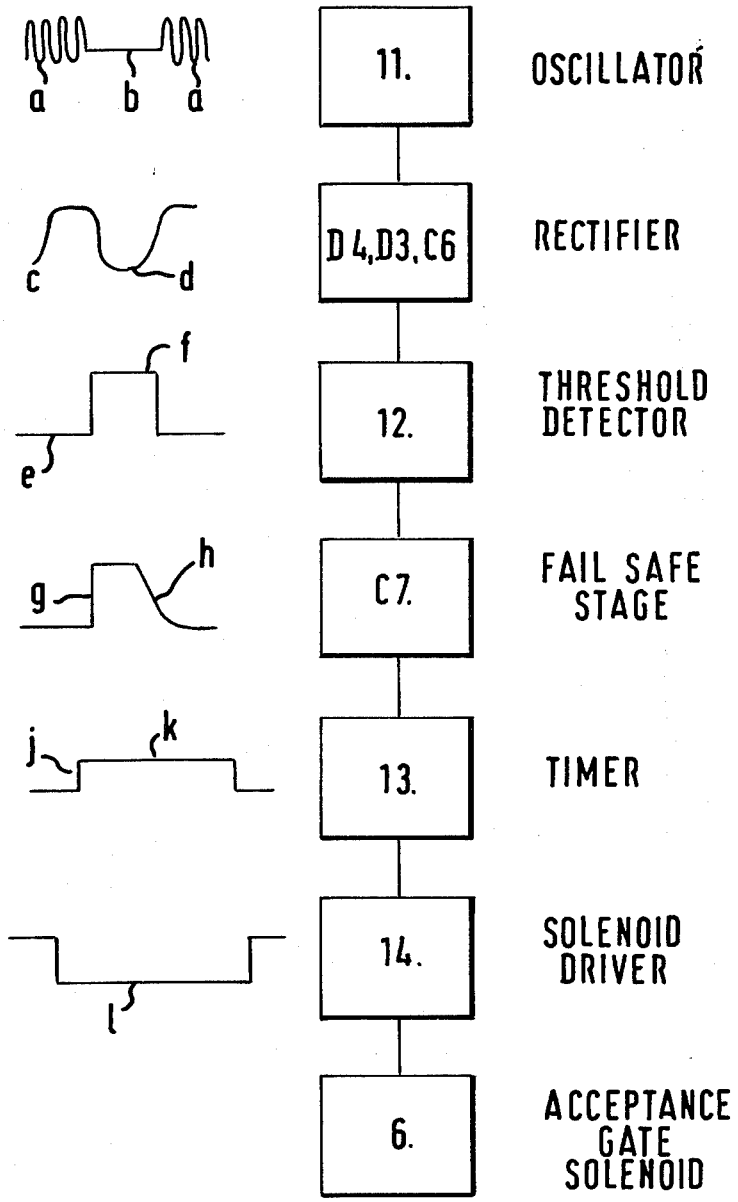
FIG. 5 illustrates signal waveforms at various points in the coin validating arrangement.

In the following description, lower case reference letters refer to the waveform illustrations given in FIG. 5.

Passage between the sensing coils L1 and L2 of any coin which does not temporarily stop the steady oscillation (a) of the amplifier 11, or markedly reduce its amplitude, has no effect on the solenoid 6, so that such a coin is deflected into the rejection path 8. Passage of a correct coin causes a temporary quenching (b) of the oscillation (a), with the result that the voltage (c) of capacitor C6 collapses (d), the output (e) of the threshold detector 12 goes high (f), the capacitor C7 is charged (g) and progressively discharged (h) by diode D6, the capacitor C8 is charged (j), the output of the amplifier 13 goes high (k), and the solenoid driver transistor 14 is switched (l), thus energizing the solenoid 6 and opening the coin acceptance gate 7. The time delay between sensing of the correct coin by the coils L1 and L2 and movement of the coin as far as the acceptance gate 7 is bridged by the storage action of the capacitor C8.

If the amplifier 11 should fail or if a correct coin should become lodged between the sensing coils L1 and L2, the output of the amplifier 12 would be permanently high. The provision of capacitor C7 and diode R6 ensures that in such a case the acceptance gate 7 will not remain open. Capacitor C7 is of greater capacitance than capacitor C8 so that when the output of the amplifier 12 goes high, capacitor C8 charges up before capacitor C7, whereupon no further current will flow. Capacitor C7 is discharged through diode D6 when the output of the amplifier 12 goes low, on the re-establishment of oscillation in the circuit of the amplifier 11.

The three operational amplifiers 11, 12 and 13 may be part of a DIL integrated circuit containing four such amplifiers.

The arrangement described above is very suitable for detecting correct 50 pence British coins, because normally used slugs and blanks do not have the correct resistivity/permeability characteristics to quench the oscillator when it has been adjusted for quenching by the presence of a 50 pence coin. Smaller British coins, such as 10 pence, do not quench the oscillator because although of the same alloy such smaller coins do not register with a sufficient area of the sensing coils.

Modifications are possible. For example the threshold detector may be arranged to be sensitive to a lower amplitude of oscillation rather than total quenching of oscillation. This gives the possibility of providing an arrangement able to accept various different correct coins. For this purpose, a plurality of different threshold detectors could be provided, or window comparators could be used.

Figure 4:
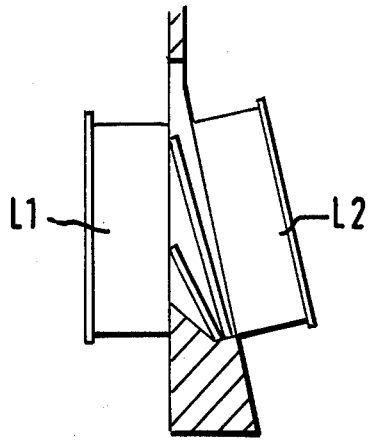
FIG. 4 illustrates a cross-section of a coin guide path and sensing coil arrangement suitable for use with coins of various different diameters.

For added discrimination in multi-coin systems, diameter checking devices can be provided, using photocells or using measurement coils of smaller diameter. Also, coin diameter may be evaluated by determining the angle of lean of a coin as the coin rolls past the sensing coils, as is shown in FIG. 4, this figure showing a large coin and a smaller coin, having different angles of lean and thus different influences on the sensing coils.

Figure 6:
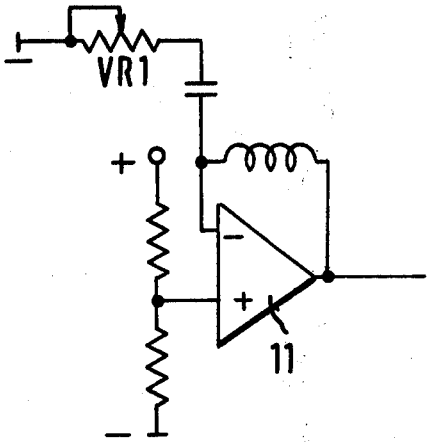
FIG. 6 is a detail view illustrating a modification of the oscillator/amplifier of the circuit arrangement of FIG. 3.

Although the embodiment described above uses two closely spaced sensing coils, and this is desirable for obtaining high sensitivity together with stability, it is possible for the arrangement to use a single sensing coil. The necessary modification to the amplifier/oscillator circuit in such a case is illustrated in FIG. 6. Also, more than one pair of coils may be provided, each pair being arranged for being brought into an oscillation quenching state by the presence of a correct coin unique to the particular coil pair.

The arrangement of the invention has been found to be stably operable over temperatures ranging from 0 degrees C. to 70 degrees C. The use of operational amplifiers makes a simple arrangement of the sensing coils possible, and avoids the requirement of separate oscillating and reference coils used in some known systems. Moreover, the possibility of adjustment by a single variable control, that is to say the resistor VR1, is an advantage.

In its normal stand-by state, the arrangement draws very little current, so that it is practicable to use a battery power supply.

It will be appreciated that the operation of the arrangement of the invention depends on the change caused in a field of a sensing coil or set of sensing coils on passage of a coin past the coil. Correct coins of certain metals can be emulated by blanks using a different metal or alloy, but normally only if the dimensions of the blanks differ from the dimensions of the correct coins. Such blanks can readily be detected by a separate check of another parameter, such as diameter.

When the correct coins are bronze, such emulation is relatively easy, and the provision of a diameter checking station would be desirable. When the correct coins are cupro nickel, there is no great need to provide for checking of a second parameter, because metal blanks which would influence the sensing coils in the same way as correct coins are not readily available.

The construction and arrangement of the sensing coils significantly influences the detection sensitivity for a given type of coin. The modified sensing coil construction shown in FIG. 7 has been found to enable effective detection of correct bronze coins, which are easy to emulate for less sophisticated sensing arrangements.

Figure 7:
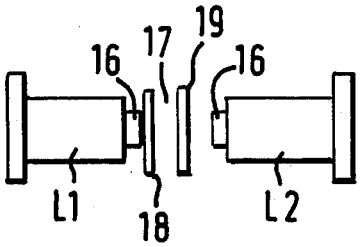
FIG. 7 illustrates a modified construction of the sensing coils.

In FIG. 7, the sensing coils L1 and L2 are provided with ferrite cores 16 and the oscillator can be operated at a higher frequency than is the case for the air-cored sensing coils of FIG. 3. The coin guide path 17 between the sensing coils is flanked on one side by a brass shim 18, the position of the coin during detection being indicated by reference numeral 19. The arrangement of FIG. 7 enables reliable detection of bronze coins such as a British two pence coin.

The frequency of the oscillator is preset by component and coin values to give the most effective sensing for the particular coin to be tested.

The oscillator can be used to resonate a single coil only. With such an arrangement, a search coil is usually positioned opposite the single coil and operable to vary mainly with respect to the coins diameter.

Figure 8:
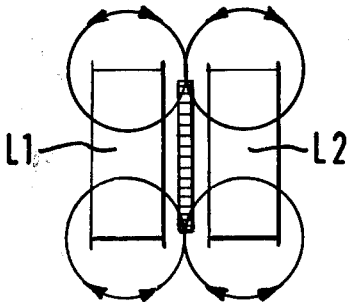
FIG. 8 illustrates an alternative flux pattern which may be used in the detection of ferrous and semi-ferrous coins.

Coils connected to generate an anti-phase flux pattern as shown in FIG. 8 are particularly suitable for the detection of ferrous and semi-ferrous coins such as the 5 and 2 German Mark. Used in conjunction with the system of FIG. 2, the particular characteristics of the latter mentioned coins are detectable.

I claim:

1. A coin-validating arrangement, comprising (a) coin guide means defining a coin guide path (3);

(b) oscillation circuit means including (1) fixed biased amplifier means (11) having input and output terminals;

(2) tuned circuit means including at least one coil arranged adjacent said coin guide path, said tuned circuit means being connected between said amplifier output and input terminals to define a negative feed back path; and (3) means including a variable resistor (VR1) for applying to said tuned circuit means a potential normally producing a phase shift sufficient to result in positive feedback in said amplifier means and oscillation of said oscillation circuit means, said oscillation circuit means being operable to a non-oscillating quenched condition when a given coin having predetermined physical characteristics is temporarily positioned adjacent said coil;

(c) normally closed acceptance gate means (7) arranged in said coin path;

(d) detecting means for detecting the quenching of the oscillations of said oscillation circuit means by said given coin; and (e) means operable by said detecting means when said oscillation circuit means is in the quenched condition for opening said acceptance gate means, thereby to permit the passage of the given coin therethrough.

2. Apparatus as defined in claim 1, wherein said tuned circuit means includes two spaced sensing coils (L1, L2) arranged on opposite sides of said coin guide path, said sensing coils being so arranged that during oscillation of said oscillation circuit means, said coils produce fluctuating fields that extend through both coils.

3. Apparatus as defined in claim 2, wherein said sensing coils are connected in parallel to define a parallel branch and further including capacitor means connected in parallel with said sending coil parallel branch.

4. Apparatus as defined in claim 2, wherein said sensing coils include ferrite cores (16) the adjacent end regions of which border said coin guide path, and further including a non-ferrous shim (18) arranged between the end region of one of said cores and said coin guide path.

5. Apparatus as defined in claim 2, wherein said coin guide means includes means causing coins of different diameters to have different angles of inclination relative to said sensing coils, respectively, during travel of the coins along said guide path.

6. Apparatus as defined in claim 1, wherein said amplifier means includes an operational amplifier (11) having an output terminal, an inverting input terminal, and a non-inverting input terminal, and means applying a fixed bias to said non-inverting input terminal, said tuned circuit means being connected between said output and said inverting input terminals.

7. Apparatus as defined in claim 6, wherein said amplifier means also includes a resistor (R1) and a diode (D2) connected in series to define a series branch, and series branch being connected in parallel with said tuned circuit means.

8. A coin-validating arrangement, comprising (a) coin guide means defining a coin guide path (3);

(b) oscillation circuit means including (1) amplifier means (11) having input and output terminals; and (2) tuned circuit means including at least one coil arranged adjacent said coin guide path, said tuned circuit means being connected between said amplifier output and input terminals to define a negative feedback path, said tuned circuit means being normally operable to produce a phase shift sufficient to effect positive feedback and operation of said oscillation circuit means to an oscillating condition, said tuned circuit means being operable when a coin having given physical characteristics is adjacent said coil for quenching oscillation of said oscillation circuit means;

(c) normally closed acceptance gate means (7) arranged in said coin path;

(d) detecting means for detecting the quenching of the oscillations of said oscillation circuit means by said given coin, said detecting means including (1) a detector capacitor (C6);

(2) rectifier circuit means (D3, D4) for charging said detector capacitor, said rectifier circuit means including an input terminal connected with the amplifier output terminal, and an output terminal connected with said detector capacitor; and (3) threshold detector means (12) connected with said detector capacitor, said threshold detector means being operable between a normal first condition when said oscillation circuit means is in the oscillating condition and said detector capacitor is charged to a given threshold level, and a second condition when said oscillation circuit means is in the quenched condition and the charge on said detector capacitor is less than said threshold level; and (e) means (6) operable when said threshold detector means is in its second condition for operating said acceptance gate means to the open condition, thereby to pass the given coin through said acceptance gate.

9. An arrangement as defined in claim 8, wherein two sensing coils are provided which are spaced apart from each other with the coin guide path extending between them.

10. An arrangement as defined in claim 9, wherein the coin guide path and the sensing coils are so constructed that coins of different diameters have a different angle of lean relative to the sensing coils as the coins roll along the guide path.

11. An arrangement as defined in claim 9, wherein the sensing coils are so arranged that during said oscillation the coils produce fluctuating fields extending through both the coils.

12. An arrangement as defined in claim 11, wherein the coils are connected in parallel and in parallel with a capacitor or capacitor network.

13. An arrangement as defined in claim 11, wherein the sensing coils have ferrite cores.

14. An arrangement as defined in claim 13, wherein end regions of the ferrite cores border the coin guide path, said arrangement further comprising a non-ferrous shim disposed between one said end region and the coin guide path.

15. An arrangement as defined in claim 8, wherein the output of the threshold detector means is connected to a timing stage comprising a capacitor and an amplifier, the timing stage amplifier being arranged to provide an output signal when the voltage on the timing stage capacitor equals or exceeds a given reference voltage, corresponding to the supply of a signal from the threshold detector.

16. An arrangement as defined in claim 15, wherein a capacitor of greater capacitance than the timing stage capacitor is connected between the output of the threshold detector stage and the timing stage, a diode being provided for discharging this interposed capacitor when the output of the threshold detector stage goes low, the interposed capacitor and the last said diode serving as a fail safe stage preventing permanent energization of the timing stage and acceptance gate opening means, in the event of any fault occurring which renders the output of the threshold detector permanently high.

17. An arrangement as defined in claim 16, wherein the output of the timing stage is connected to a switching stage arranged to control the energization of a solenoid constituting the said means for opening the coin acceptance gate.

18. An arrangement as defined in claim 17, wherein the switching stage is a transistor switching stage.

* * * * *